United States Patent [19]

Stanley

[11] 3,978,559

[45] *Sept. 7, 1976

[54] YARN TREATING APPARATUS

[75] Inventor: Robert K. Stanley, Media, Pa.

[73] Assignee: Techniservice Corporation, Kennett Square, Pa.

[ * ] Notice: The portion of the term of this patent subsequent to May 7, 1991, has been disclaimed.

[22] Filed: Nov. 11, 1974

[21] Appl. No.: 522,424

Related U.S. Application Data

[63] Continuation of Ser. No. 456,033, March 29, 1974, which is a continuation of Ser. No. 214,893, Jan. 3, 1972, Pat. No. 3,808,654, which is a continuation of Ser. No. 846,457, July 31, 1969, Pat. No. 3,781,952, which is a continuation-in-part of Ser. No. 684,230, Nov. 20, 1967, Pat. No. 3,462,815, Ser. No. 678,428, Oct. 26, 1967, Pat. No. 3,462,814, Ser. No. 606,420, Dec. 30, 1966, and Ser. No. 835,883, June 9, 1969, Pat. No. 3,559,254, said Ser. No. 684,230, and Ser. No. 678,428, each is a continuation-in-part of Ser. No. 302,758, July 31, 1963, Pat. No. 3,376,622, which is a continuation-in-part of Ser. No. 790,658, Feb. 2, 1959, Pat. No. 3,111,740, and Ser. No. 216,524, July 13, 1962, abandoned, said Ser. No. 606,420, is a continuation-in-part of Ser. No. 386,489, July 31, 1964, Pat. No. 3,317,977, which is a continuation-in-part of Ser. No. 216,447, July 13, 1962, Pat. No. 3,145,947, said Ser. No. 835,883, is a continuation-in-part of Ser. No. 650,762, July 3, 1967, abandoned, which is a continuation-in-part of Ser. No. 349,338, March 4, 1964.

[52] U.S. Cl. ..... 28/1.6

[51] Int. Cl.[2] ..... D02G 1/12

[58] Field of Search ..... 28/1.6, 62, 72.14, 1.8, 28/1.3, 71.3

[56] References Cited

UNITED STATES PATENTS

| | | | |
|---|---|---|---|
| 2,302,792 | 11/1942 | Moritz | 28/71.3 X |
| 2,611,923 | 9/1952 | Hume | 28/62 X |
| 2,686,339 | 8/1954 | Holt | 28/72.14 |
| 2,914,810 | 12/1959 | Robinson et al. | 28/1.6 X |
| 2,921,358 | 1/1960 | Cox et al. | 28/1.5 |
| 2,949,659 | 7/1960 | Heinnis et al. | 28/1.6 |
| 2,974,392 | 3/1961 | Timbie | 28/1.8 |
| 3,099,064 | 7/1963 | Haynes et al. | 28/1.3 |
| 3,137,912 | 6/1964 | Preston et al. | 28/1.5 |
| 3,144,680 | 8/1964 | Heighton | 28/71.3 X |
| 3,152,379 | 10/1964 | Osban | 28/1.6 |
| 3,413,697 | 12/1968 | Agett et al. | 28/1.3 |
| 3,454,998 | 7/1969 | Satterwhite | 28/1.6 |
| 3,614,818 | 10/1971 | Satterwhite | 28/1.6 |

FOREIGN PATENTS OR APPLICATIONS

| | | | |
|---|---|---|---|
| 774,807 | 1/1968 | Canada | 28/1.6 |
| 806,361 | 2/1969 | Canada | 28/1.6 |
| 1,535,468 | 7/1968 | France | 28/72.14 |
| 414,931 | 12/1966 | Switzerland | 28/1.6 |

*Primary Examiner*—Louis K. Rimrodt
*Attorney, Agent, or Firm*—Miller, Frailey & Prestia

[57] ABSTRACT

Textile yarns or strands are heated, as by contact with hot rolls, and then are crimped, preferably compressively as in a stuffer crimper, after being drawn to increased length if so drawable.

3 Claims, 15 Drawing Figures

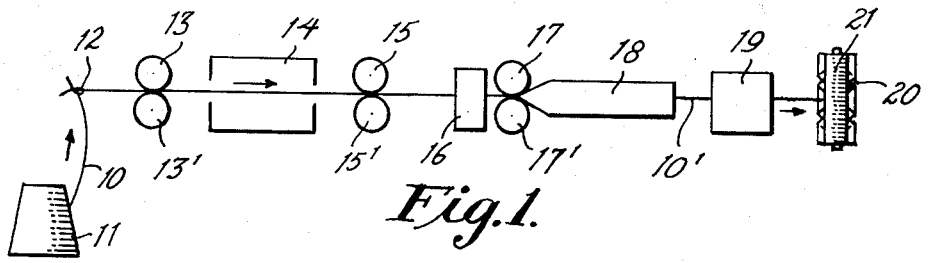
Fig.1.
Fig.2.
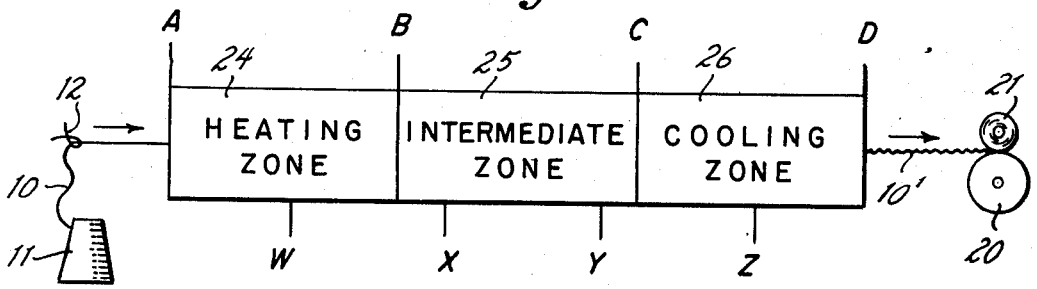
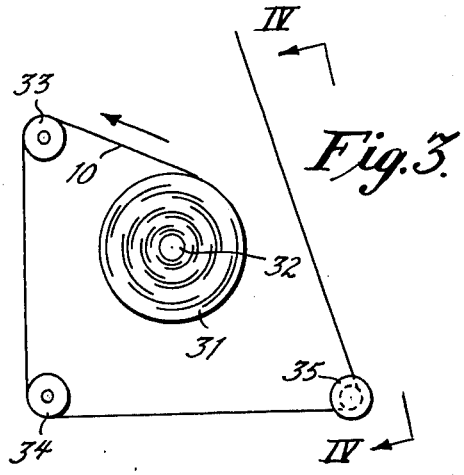
Fig.3.
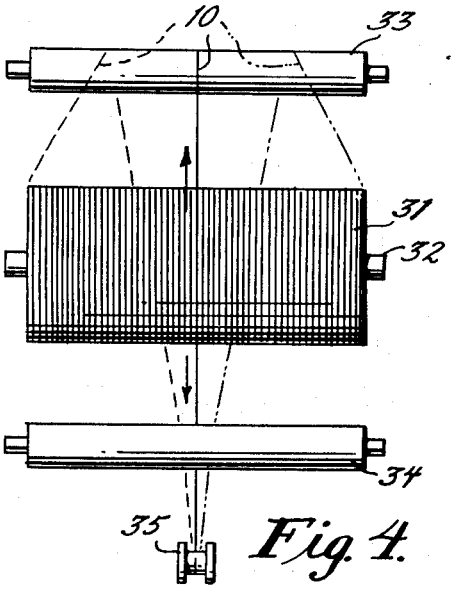
Fig.4.
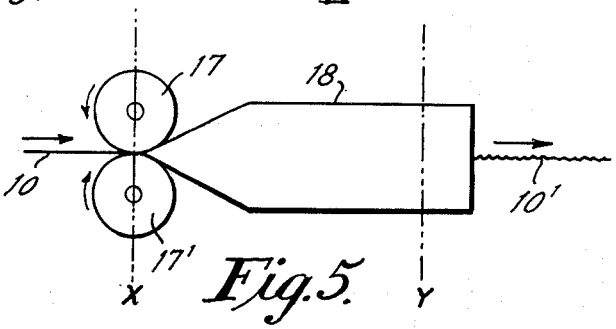
Fig.5.

YARN TREATING APPARATUS

This application is a continuation of my similarly entitled copending application, Ser. No. 456,033 filed Mar. 29, 1974, now abandoned. That application was a continuation of my copending application Ser. No. 214,893 filed Jan. 3, 1972, and now U.S. Pat. No. 3,808,654, which itself was a continuation of my copending application Ser. No. 846,457 filed July 31, 1969 and now U.S. Pat. No. 3,781,952. That application was a continuation-in-part of each of my following (parenthetically enumerated) pending applications, each of which is listed with reference to previously copending applications and their predecessor applications with which there was continuity, and the benefits of which are claimed for this application:

i. Ser. No. 684,230 filed Nov. 20, 1967 and now U.S. Pat. No. 3,462,815, and ii. Ser. No. 678,428 filed Oct. 26, 1967 and now U.S. Pat. No. 3,462,814, both as continuations-in-part of Ser. No. 302,758 filed July 31, 1963 and now U.S. Pat. No. 3,376,622, which was in pertinent part a continuation-in-part of Ser. No. 790,658 filed Feb. 2, 1959 and now U.S. Pat. No. 3,111,740 and of subsequently abandoned Ser. No. 216,524 filed Aug. 13, 1962; and iii. Ser. No. 606,420 filed Dec. 30, 1966, as a continuation-in-part of Ser. No. 386,489 filed July 31, 1964 and now U.S. Pat. No. 3,317,977, which was in pertinent part a continuation-in-part of Ser. No. 216,447 filed Aug. 13, 1962 and now U.S. Pat. No. 3,145,947; and iv. Ser. No. 835,883 filed June 9, 1969 and now U.S. Pat. No. 3,559,254 as a continuation-in-part of subsequently abandoned Ser. No. 650,762 filed July 3, 1967, which was in pertinent part a continuation-in-part of Ser. No. 349,338 filed Mar. 4, 1964 now U.S. Pat. No. 3,348,283.

This invention relates to treatment of textile yarns or strands, including heating pretreatment and optional drawing to increased length followed by compressive crimping thereof.

A primary object of the present invention is enhanced uniformity in compressive crimping of textile yarns or strands.

Another object is improvement in configuration or stability (or both) of crimp therein.

A further object is provision of a combined drawing and crimping process therefor.

Other objects of this invention, together with means and methods for attaining the various objects, will be apparent from the following description and the accompanying diagrams.

FIG. 1 is a schematic representation of the processing of a textile yarn or strand according to this invention;

FIG. 2 is a schematic representation, largely in block form, of such processing;

FIG. 3 is a side elevation of means for supplying a textile yarn or strand for such processing from an illustrated alternative source package thereof;

FIG. 4 is a front elevation of the components of FIG. 3 taken at an inclination as indicated at IV—IV; and FIG. 5 is a schematic representation of a stuffer-crimper useful according to preceding views, with especial reference to FIG. 2.

Figure 7:
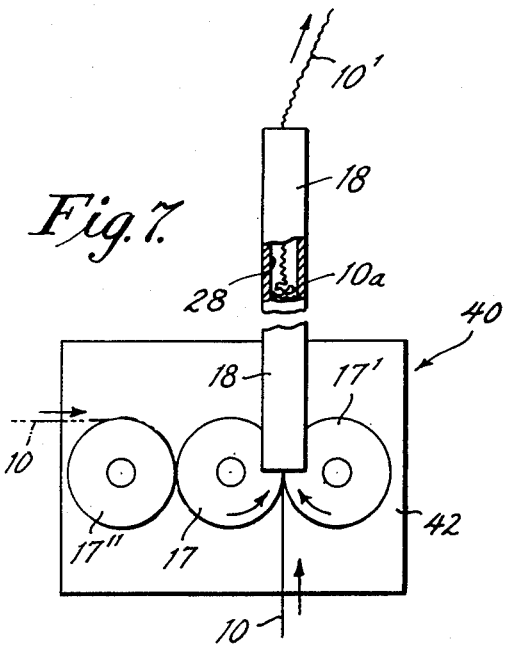
Figure 8:
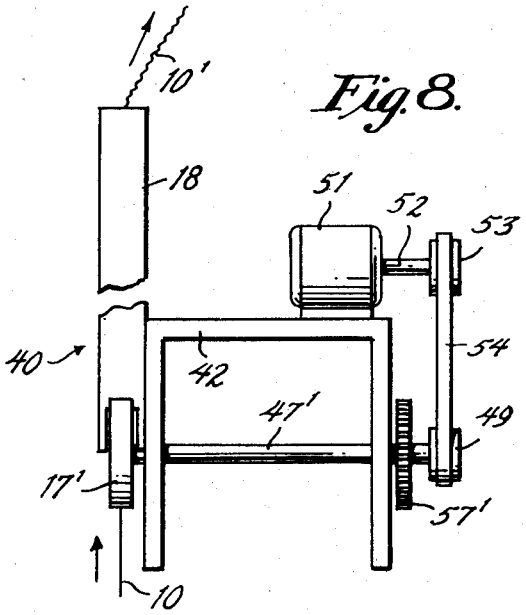
Figure 6A:
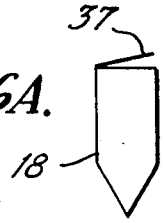
Figure 6B:
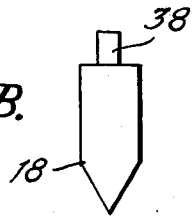
Figure 6C:
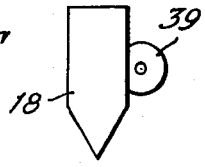

FIGS. 6A, 6B, and 6C are schematic representations of stuffer crimpers so useful and including movable impeding or back-pressure components;

FIG. 7 is a front elevation, partly cut away, of such a stuffer crimper in further detail and showing a yarn or strand passing therethrough;

FIG. 8 is a side elevation of the stuffer crimper shown in FIG. 6; and

Figure 9:
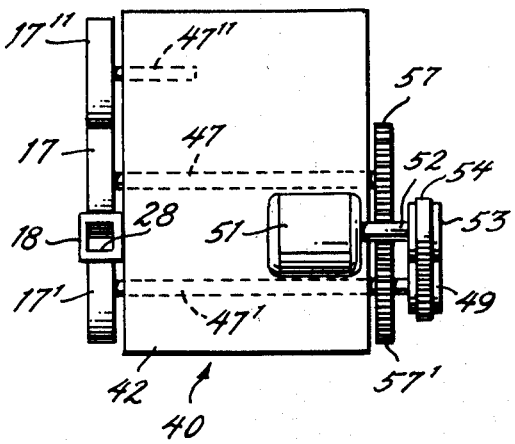

FIG. 9 is a plan view of the stuffer crimper of the preceding views, less the yarn or strand.

Figure 10:
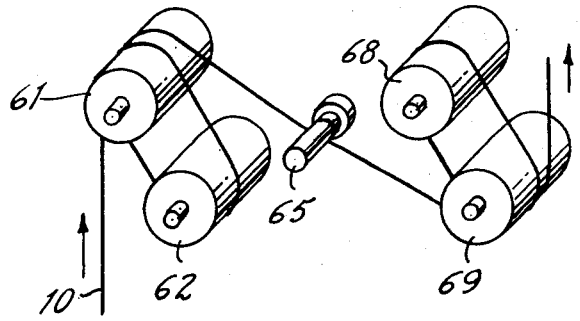
Figure 11:
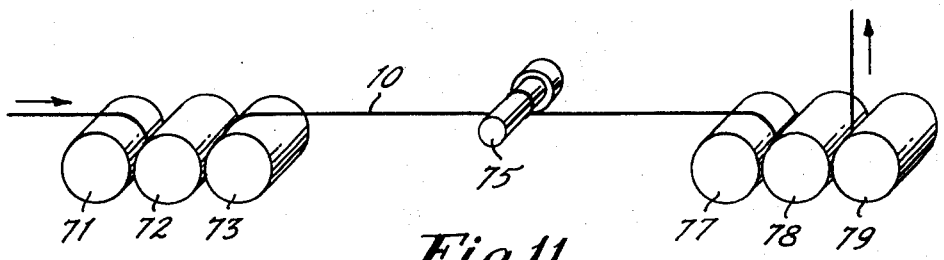
Figure 12:
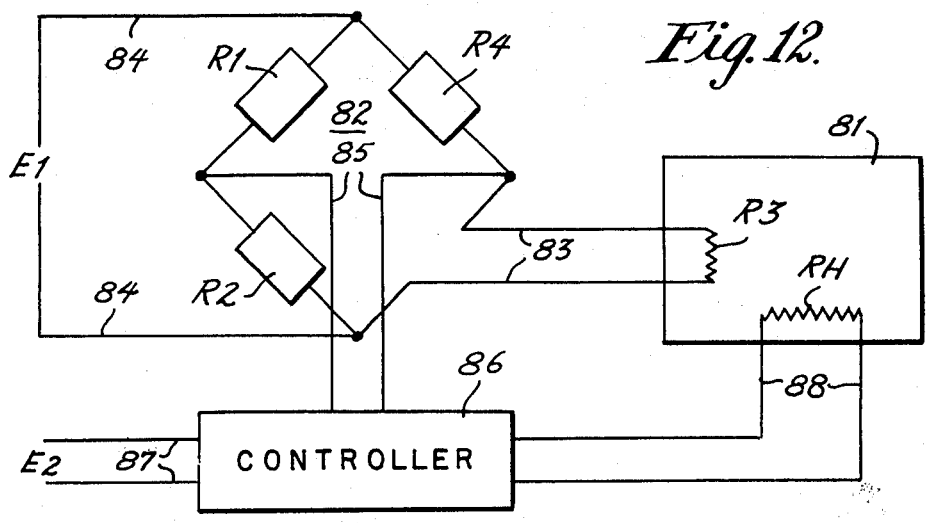
Figure 13:
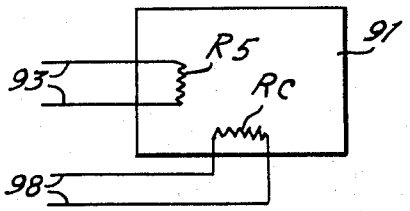

FIG. 10 is a perspective view somewhat stylized, of an arrangement of drawing components useful according to this invention;

FIG. 11 is a perspective view of an alternative arrangement of drawing components similarly useful;

FIG. 12 is a schematic representation of electrical circuitry and related components useful according to this invention; and FIG. 13 is a schematic representation of other electrical circuitry and related components useful therein.

In general, the objects of the present invention are accomplished, in the treatment of textile yarns or strands, by heating the same without sliding contact with any solid heating surface, and then compressively crimping the same, as in a stuffer crimper having a temporarily confining chamber defining an accumulating or bunching zone therefor. If drawable to increased length, whether undrawn or only partially drawn, the yarns or strands are passed in essentially non-slipping contact with successive sets of rolls rotating at successively increasing surface speeds and are so heated as to ensure drawing as well as crimping thereof, after which they are cooled or allowed to cool.

FIG. 1 shows, largely schematically, strand 10 unwinding over the end of conical package 11 and thereby acquiring a slight twist, to be withdrawn linearly or lengthwise and be so advanced or forwarded through guide 12 and successive pairs of rolls 13, 13' and 15, 15'. Enclosure 14, which may be heated, as by hot-air convection or by an electrical radiant-heating element (not shown) or which may simply constitute a barrier to loss of heat to the atmosphere from the yarn or strand, which is readily heated by the rolls, extends thereabout between the respective sets of rolls and may extend to or even about the rolls, if desired.

Although not illustrated, methods and means for heating the rolls, preferably internally, will come readily to the mind of a person skilled in the art: e.g., by circulation of heated fluid therein or by electrical means as disclosed in my U.S. Pat. No. 3,111,740, especially FIGS. 6 to 8 and the description thereof. Traversing means 16, optionally used for assisting in distribution of the yarn or strand along the nip of feed rolls 17, 17', follows the second pair of rolls and precedes the feed rolls at the entrance to stuffing chamber 18, to which the yarn or strand proceeds directly from rolls 15, 15'. Compressively crimped yarn or strand 10' (so designated to distinguish it from the uncrimped starting form) is wound up from the exit of the chamber past aftertreating means 19, in which it is adjusted in tension or temperature (or both) and onto traverse-wound package 21 by self-traversing drive roll 20 rotating in contact therewith.

FIG. 2 shows schematically the location of heating, intermediate, and cooling zones, represented in block form, between the supply and windup components of FIG. 1. After leaving guide 12, yarn or strand 10 passes successively through Heating Zone 24, which has initial and final boundaries A and B; Intermediate Zone 25, which has initial and final boundaries B and C; and Cooling Zone 26, which has initial and final boundaries C and D; after which it is wound by roll 20 onto package 21 as previously mentioned. Location W in the heating zone, locations X and Y in the intermediate zone, and location Z in the cooling zone are characterized further below.

It will be understood that conical package 11 may be replaced by any suitable source of yarn or strand 10, such as traverse-wound package 31 shown in side and front (slightly inclined) elevation, respectively, in FIGS. 3 and 4. This package is mounted for rotation on axle 32 suitably supported. Mounted on axes parallel thereto are roll 33 located above and behind the package, roll 34 located below and behind the package, and roller guide 35 located ahead of and below the package and centered from end to end thereof. As yarn or strand 10 unreels (without acquiring any twist) from package 31 and about rolls 33 and 34 and roller guide 35, it traverses the successive rolls to a successively decreasing extent as compared with the full traverse thereof on the package, as indicated by the broken lines. This arrangement smoothes out the tension changes characteristic of a yarn or strand supplied from a traverse-wound package, thereby facilitating uniformity of further treatment and consequent elimination of objectionable irregularities in the resulting product.

FIG. 5 schematically locates feed rolls 17, 17' and stuffing chamber 18 with respect to the zones indicated in FIG. 2. Location X in the intermediate zone is denoted as coincident with the roll axes, and location Y (also in the intermediate zone) as at or near the end of the chamber, wherever the yarn or strand is released from the impeding force or back-pressure that applies crimping stress thereto.

FIGS. 6A, 6B, and 6C show, also schematically, three conventional types of stuffing (of stuffer box) chambers 18, with particular reference to impeding or back-pressure elements for the yarn or strand therein, in the order of their development: gravity-actuated or spring-loaded gate 37 in FIG. 6A; reciprocating plunger 38, without or with a central longitudinal bore, in FIG. 6B; and unidirectionally movable or moving wheel (which also comprehends belts, etc.) or gear-like element 39 in FIG. 6C. Each of these types of impeding means applies back-pressure to crimped yarn or strand 10' seeking to escape from the chamber, or from that part thereof in which it is under crimping stress, as the feed rolls (shown previously) or equivalent means forcibly stuff more uncrimped yarn or strand 10 into the chamber. Examples of these respective types may be found in U.S. Pat. Nos. 2,686,339, 2,734,229, and 3,027,619; hence, the omission of most details of their construction. The rate of windup or other withdrawal of crimped yarn or strand 10' may be synchronized in timed relation to the rate of feed of uncrimped yarn or strand 10 into the stuffing chamber as disclosed in my U.S. Pat. Nos. 3,280,444 and 3,388,440, especially FIGS. 4 to 9 thereof and the related description, if desired.

FIGS. 7, 8, and 9 show in front elevation, side elevation, and top plan, respectively, stuffer crimper 40 embodying feed rolls 17, 17' and stuffing chamber 18, as well as related components. No impeding element, such as previously illustrated and described, is included in this view, it being understood that one may be used therewith, if desired; alternatively, lateral confinement by and friction with the sidewalls of the stuffing chamber may suffice, as disclosed in my aforementioned U.S. Pat. Nos. 3,279,025 and 3,386,142. As shown in FIG. 7, part of the front wall of stuffing chamber 18 is cut away to reveal crimped strand 10' inside chamber bore 28 being withdrawn (as by roll 20 of FIG. 1) from the leading or head end of accumulation **10*a*** thereof in the form of a bunched or compressed wad or plug in the lower part of the chamber and which otherwise would extend at least to any impeding element used therewith.

Also shown in FIGS. 7, 8, and 9 is frame 42, which supports stuffing chamber 18 and related components and which has an inverted U-shape as viewed from the side (FIG. 8). Shafts 47, 47' for respective feed rolls 17, 17' are journaled in the front and rear walls of the frame and have intermeshing gears 57, 57' thereon behind the rear wall of the frame. Shaft 47' also has driven pulley 49 affixed thereon. Motor 51 on the horizontal upper surface of the frame has shaft 52 on which is drive pulley 53. Belt 54 interconnects pulleys 53 and 49 to transmit rotational force from the motor to the gears, shafts, and the feed rolls themselves. Also shown is roll 17'' carried on stub shaft 47'' parallel to and aligned with the feed rolls and their shafts, with the peripheral surface of roll 17'' contiguous with the peripheral surface of feed roll 17 on one side thereof as is the peripheral surface of feed roll 17' on the opposite side. The tapered entrance of the stuffing chamber, shown schematically in earlier views, extends within the bight of the feed rolls but is hidden from view by the lower end of the chamber, the front and rear walls of which overlap portions of the front and rear faces of the rolls as far as the roll nip so as to ensure that the infed yarn or strand enters the chamber rather than possibly escaping therefrom.

The stuffing chamber and other rigid apparatus elements may be made of steel or other durable material. If desired, the inside wall of the chamber may be coated (e.g., with tetrafluoroethylene) to reduce the coefficient of friction, in which event the chamber should be lengthened accordingly. In the absence of any impeding element a chamber length of about a yard or meter, with a bore width of about a quarter inch or a centimeter for use with yarns or strands of about 10 to 100 denier, has proved suitable for nylon and similar textile materials, such as will come readily to the mind of a person skilled in the textile arts.

Prominent among suitable textile compositions are the nylons (polycarbonamides), e.g., 66 nylon (i.e., polyhexamethylene adipamide), also 6-nylon, 11 nylon, 610 nylon, and fiber-forming copolymers thereof, including terpolymers. Other suitable polymeric materials for yarns or strands to be treated according to this invention include most of the thermoplastic fiber-forming materials, such as polyhydrocarbons (e.g., polyethylene, polypropylene), polyesters (e.g., polyethylene terephthalate), polyacrylonitrile and copolymers of acrylonitrile with other vinyl compounds, also copolymers of vinyl chloride and vinylidene chloride, and polyurethanes. This list is simply exemplary and is not intended to be exhaustive of suitable compositions, most or all of which are thermosplastic.

According to this invention, thus far considered, yarn or strand 10 is withdrawn from a suitable source of supply, then is heated by or between successive sets of rolls without sliding contact with a heated solid surface and is stuffed while hot into a confining chamber, within which it is subjected to longitudinal compression to buckle it into crimped configuration and from which it is then withdrawn and usually wound up. The entering yarn or strand usually is fed or driven into the roll nip and the juxtaposed chamber entrance from along the common internal tangent thereto extended therefrom, as shown in solid in FIG. 7. Where it is desired to grip the yarn or strand over a greater distance than is provided by the nip of feed rolls 17, 17' it may proceed along the alternative path, shown there in broken lines beginning at the left of the view and extending about a quadrant or so of added roll 17'', downward through the nip of rolls 17'' and 17, about the lower half of roll 17, and then upward to the nip of rolls 17, 17' and the chamber entrance.

The heated yarn or strand enters the stuffing chamber at desired crimping temperature, which is dependent upon the composition, denier, processing rate, time in the chamber, etc., and often is within the range of 150°to 350°F. So long as it is under substantial crimping compression it preferably is kept under adiabatic conditions, or with addition (or subtraction) of heat such as may be required to compensate for heat loss (or frictional heating) and thereby to maintain essentially constant-temperature conditions until completion of crimping. Then heat is removed from the crimped yarn or strand in the cooling zone to bring it to approximately room temperature, as by ventilation with cool air or otherwise, it being recognized that the crimped yarn or strand probably will have cooled somewhat (e.g., to about 120°F.) before reaching the stuffing chamber exit. Such cooling prevents undesired deformation that might occur in hot yarn or strand wound into package form.

Although the diagrams illustrate only what appears to be a monofilament, it will be understood that yarns or strands suited for treatment according to this invention include also multifilaments and composite structures comprising shorter lengths (e.g., staple) than are usually considered to be continuous filaments. Although many, if not all, of the suitable compositions are drawable to increased length, usually resulting in orientation of their component macromolecules longitudinally, detailed consideration of drawability of the yarns or strands being treated has been deferred to here in this application in the interest of orderliness and simplicity of description and illustration.

It has been customary to accomplish such orientation of drawable textile yarns or strands by a drawing process removed or unrelated in location and time (being prior, usually long prior) with respect to whatever crimping process is applied thereto to enhance their bulk, cover, hand, texture, etc. Most crimping processes tend to extend the subject yarn or strand axially while deforming it transversely of the longitudinal axis, as in edge-crimping, gear-crimping, jet-crimping, and twist-crimping. While there might be reason to believe that it would be feasible to perform such an extensional crimping process soon after drawing, as together with performance of one or more additional steps, the same is not true of a compressive or compressional crimping process, such as stuffer crimping.

The general view is that the usual time lag between drawing and stuffer crimping presumably permits the condition of increased orientation and length to become desirably stabilized. There is a greater contradiction involved in first extending a yarn or strand longitudinally and then immediately compressing it longitudinally than there is in extending it in both a drawing step and a following crimping step. However, the present invention provides a drawing step followed by a compressive crimping step without appreciable time intervening, i.e., as a draw-crimping process.

FIGS. 10 and 11 show in perspective two suitable arrangements for so drawing yarns or strands to increased length directly before crimping, each such arrangement consisting of two sets of rolls variously arranged but flanking a draw pin such as is optionally useful in localizing the draw. It will be understood that at least one of the rolls in each of these two sets is driven by suitable motive means (not shown) and that all the rolls within each set rotate at constant speed, whether driven directly by the motive means or indirectly by contact (essentially non-slipping) with the strand or with one another. The surface speed of the rolls in the second or forwarding set is sufficiently greater than the speed of the rolls in the first or input set to draw the yarn or strand to desired increased length therebetween. The draw pin does not rotate but is fixed so as to snub the strand passing about it. The pin may, but need not, be heated by any conventional means (e.g., electrically or by steam, preferably supplied internally) in accordance with the art of textile drawing.

In FIG. 10, pair of input rolls 61, 62 spaced from one another in godet fashion precede draw pin 65, and similar pair of output or forwarding rolls 68, 69 follow the draw pin. Yarn or strand 10 passes successively about the input pair of rolls as a group, about the draw pin, and about the output pair or rolls as a group. Additional wraps about the respective pairs of rolls may be employed ir required for essentially non-slipping contact therewith.

In FIG. 11, input rolls 71, 72, 73 are arranged in a horizontal three-roll stack, and output rolls 77, 78, 79 are similarly arranged. Thus, rolls 71 and 73 flank and are contiguous with roll 72, while rolls 77 and 79 are similarly arranged with respect to roll 78. Yarn or strand passes about an upper quadrant of roll 71, through the nip between rolls 71 and 72, about the lower half of roll 72, through the nip between rolls 72 and 73, and over an upper quadrant of roll 73 in its path to draw pin 75. From the draw pin it proceeds in like manner about a quadrant of roll 77, through the nip between rolls 77 and 78, halfway about roll 78, through the nip between rolls 78 and 79 and onward to a stuffer crimper, previously shown. Because the yarn or strand is gripped by successive roll nips as well as by frictional contact with portions of the roll surfaces, complete or multiple wraps are not required to ensure essentially non-slipping roll contact.

It will be understood that either arrangement of draw rolls may be substituted for pairs of rolls 13, 13' and 15, 15' shown in FIG. 1. Heating enclosure 14 may be retained or not, as desired, but in either event it is most convenient and effective to heat one or both sets of rolls, possibly in addition to (or instead of) heating the draw pin. Heating the first set of rolls preheats the strand for drawing, rendering it generally easier to draw, and incidentally preheating it for crimping, while heating the second set of rolls in addition thereto, if desired, at least sufficiently to prevent the drawn strand from cooling in the interim (however brief) before crimping, is conducive to a steady and high degree of crimping. Of course, as can be seen readily from the prior discussion hereinabove, even heating only the second set of rolls is often beneficial to the degree of crimp. Although not illustrated or further decribed herein, suitable methods and means for heating the draw rolls, preferably internally, will be apparent, such as by use of heated fluid or electrical resistance elements as mentioned above in the discussion of heating one or more of rolls 13, 13′ and 15, 15′.

The relative speeds of the output and input rolls determine the draw ratio, which essentially determines the relationship of the new length of the drawn strand to its former or undrawn length. Customary draw ratios are in the range from about 2 to 6X, although sometimes higher draw ratios may be employed and lower draw ratios may be employed in individual stages of multiple-stage drawing processes. A common draw ratio for 66 nylon is 4X, corresponding to an output/input speed ratio of 4 to 1. Practicable processing speeds are undergoing continual increase and often are in the vicinity of a thousand yards or meters per minute into the crimping apparatus, but somewhat slower or faster speeds may be employed. The speed at which the strand is fed into the crimper often coincides with the output speed from the drawing zone, and in that event one or more of the crimper feed rolls may be combined with (or replaced by) one or more of the output draw rolls. For example, output draw rolls 77, 78, 79 of the draw system of FIG. 11 may coincide with rolls 17″, 17, 17′ of the stuffer crimper of FIG. 7, using the alternative path (broken lines) for the yarn or strand to be crimped. Such an arrangement further maintains the desired elevated temperature thereof and continuity of treatment without appreciable intervening delay or time lag.

FIG. 12 shows schematically suitable electrical circuitry and related components useful in assuring the desired heating and control thereof. Heating region 81, shown in block form, may constitute (or be part of) Heating Zone 24. Electrical potential E1 provides, via pair of leads 84, the input to electrical bridge 82, which may be a simple Wheatstone bridge (or a more complex type) provided with resistors (or other suitable impedance elements) R1, R2, R3, and R4 in its various arms: resistor R3 being a thermistor having pair of leads 83 and being located in region 81 to sense the temperature thereof, and the other resistors being inappreciably susceptible to resistance change with variation in temperature (or being maintained at constant temperature). The bridge output is transmitted via pair of leads 85 to Controller 86, which is supplied with electrical potential E2 via pair of leads 87 and which controls the temperature of region 81, in response to the bridge output, by means of heating element RH located in that region and connected to the controller via leads 88.

Instead of being a resistor the heating element may be suitable radiant (or other) heating means and the leads thereto be suitable piping, the controller controlling the flow of heating fluid through the piping in conventional manner as it can control the flow of heating electrical current. Further details of the controller and its connection into the circuit are omitted for simplicity, being obvious to persons having an understanding of the pertinent art.

FIG. 13 shows, also schematically, cooling region 91, which may constitute (or be part of) Cooling Zone 26. It is provided with temperature-sensitive resistor or thermistor R5 located therein and having pair of leads 93 to a bridge (not shown) by analogy to the similar elements of the immediately preceding view. Cooling element RC also located in region 91 has pair of leads 98 to a controller (not shown), the further analogy with the apparatus of FIG. 12 being apparent. The cooling element may be either a thermoelectric element or a refrigerating coil (in which instance leads 98 would be piping), for example. As suggested above a cooling element might be useful in Intermediate Zone 25 as well, such as near (inside) the entrance to the stuffing chamber where the applied longitudinal compression and resulting buckling or columnar collapse of the yarn or strand generates undesired heat, as may friction with the feed rolls or the chamber entrance itself.

With suitable insulation of the Heating, Intermediate, and Cooling Zones, such apparatus permits accurate control of the temperature thereof. The respective zones should be sufficiently large, as compared with the rate of travel of the strand therethrough, to hold the strand for a long enough time to have the desired effect upon it. Temperature-sensing means may be provided at locations W, X, Y, Z, as suggested above, or at other convenient locations to ensure accurate determination of temperature, together with temperature-controlling means as may be required for the desired temperature control. Insulation of the Intermediate Zone, which contains the crimping means, from the other two zones may suffice to ensure adiabatic conditions therein. However, if that does not suffice to maintain the strand at essentially constant temperature therein, and especially while it is under crimping stress, one or more controllers (with heating or cooling elements, or both) may be employed as in the other two zones.

While various embodiments of this invention have been disclosed, other modifications may be made, as by adding, combining, or subdividing parts or steps, while retaining significant benefits and advantages of the invention, some of which have been mentioned and others of which will become apparent to those undertaking to practice the invention in accordance with the foregoing teaching. The invention itself is defined in the following claims.

I claim:

1. Apparatus for treating thermoplastic yarn comprising an internally heated roller, means for advancing the yarn in arcuate contact with the internally heated roller, means for rotating the heated roller in the direction of the winding of the yarn in contact therewith, and means for directly crimping the thus heated yarn.

2. Apparatus for treating a thermoplastic yarn comprising a roller, means for winding the yarn at least partway around the roller, means for driving the roller in the direction of the winding of the yarn therearound to advance the yarn, means for heating the yarn as it travels in contact with with the roller, and means for directly crimping the thus heated yarn.

3. Apparatus for treating thermoplastic yarn comprising an internally heated roller, means for winding the yarn only partway around the internally heated roller, means for rotating the roller in the direction of the winding of the yarn therearound, thereby heating the yarn by means of the roller as it travels in contact with the roller, means for drawing the yarn off the roller at a greater speed than the peripheral speed of the roller, and means for directly crimping the drawn yarn while said yarn is still in a heated condition from said heating step.

* * * * *